US006398569B1

(12) United States Patent
Boyd et al.

(10) Patent No.: US 6,398,569 B1
(45) Date of Patent: Jun. 4, 2002

(54) APPARATUS AND METHOD FOR UNATTENDED DISCONNECT OF PLUG-IN CONNECTORS

(75) Inventors: Scott J. Boyd, Pflugerville; Mark S. Manley, Leander; Roy A. Rachui; Robert C. Sloan, both of Georgetown, all of TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 09/992,662

(22) Filed: Nov. 16, 2001

(51) Int. Cl.[7] ..... H01R 13/62

(52) U.S. Cl. ..... 439/258; 439/344; 439/369; 439/652; 439/719

(58) Field of Search ..... 439/352, 344, 439/369, 719, 354, 652, 353

(56) References Cited

U.S. PATENT DOCUMENTS 4,047,787 A * 9/1977 Gumb et al. ..... 339/154
5,613,869 A * 3/1997 Erlich et al. ..... 439/344
5,651,690 A * 7/1997 Klas et al. ..... 439/352
6,202,351 B1 3/2001 Medebach

* cited by examiner

*Primary Examiner*—Tho D. Ta
*Assistant Examiner*—Truc Nguyen
(74) *Attorney, Agent, or Firm*—Haynes and Boone, LLP

(57) ABSTRACT

An apparatus for automatically disconnecting a plug-in connector. A cord has a first end connected to the connector and has a second end extending from the connector. A catch member is attached to the second end. A fixed member includes an opening which is sized to permit the cord to move through the opening and to restrain the catch member from moving through the opening. As a result, movement of the connector away from the fixed member moves the cord through the opening until the catch member engages the opening, so that further movement of the connector is limited.

18 Claims, 4 Drawing Sheets

APPARATUS AND METHOD FOR UNATTENDED DISCONNECT OF PLUG-IN CONNECTORS

BACKGROUND

The disclosures herein relate generally to computer systems and more particularly to apparatus and methods used during the manufacture of such systems.

During the manufacture of computer systems, units such as computers and servers are placed onto burn racks to receive software downloads and testing of the units.

In order to conduct these burn rack operations, each unit must be connected to several plug-in devices which are of different types and sizes and are at various locations on a plug-in surface of the unit. These locations vary in height which disperses the plugs over an expanded area rather than being concentrated in a confined location. In addition, some of the plug-in devices require a greater force to become connected and disconnected. Furthermore, during disconnection, some of the devices may be simply pulled to be withdrawn whereas others, such as an RJ45 connector, require a catch to be released before withdrawal.

This presents several problems because it increases the time needed by an operator to make the disconnection of the unit.

Therefore, what is needed is a method and an apparatus for quickly and automatically disconnecting all of the plug-in connectors as a unit is removed from he burn rack without manual intervention being required to release any of the plug-in connectors.

SUMMARY

One embodiment, accordingly, provides an automatic disconnect apparatus. To this end, the apparatus is for automatic disconnect of a plug-in connector. A cord has a first end connected to the connector and has a second end extending from the connector. A catch member is attached to the second end. A fixed member includes are opening therein, the opening being of a size for permitting the cord to move therethrough and for restraining the catch member from moving therethrough. As a result, movement of the connector away from the fixed member, moves the cord until the catch member engages the opening, so that the cord permits only limited movement of the connector.

DETAILED DESCRIPTION

Figure 1:
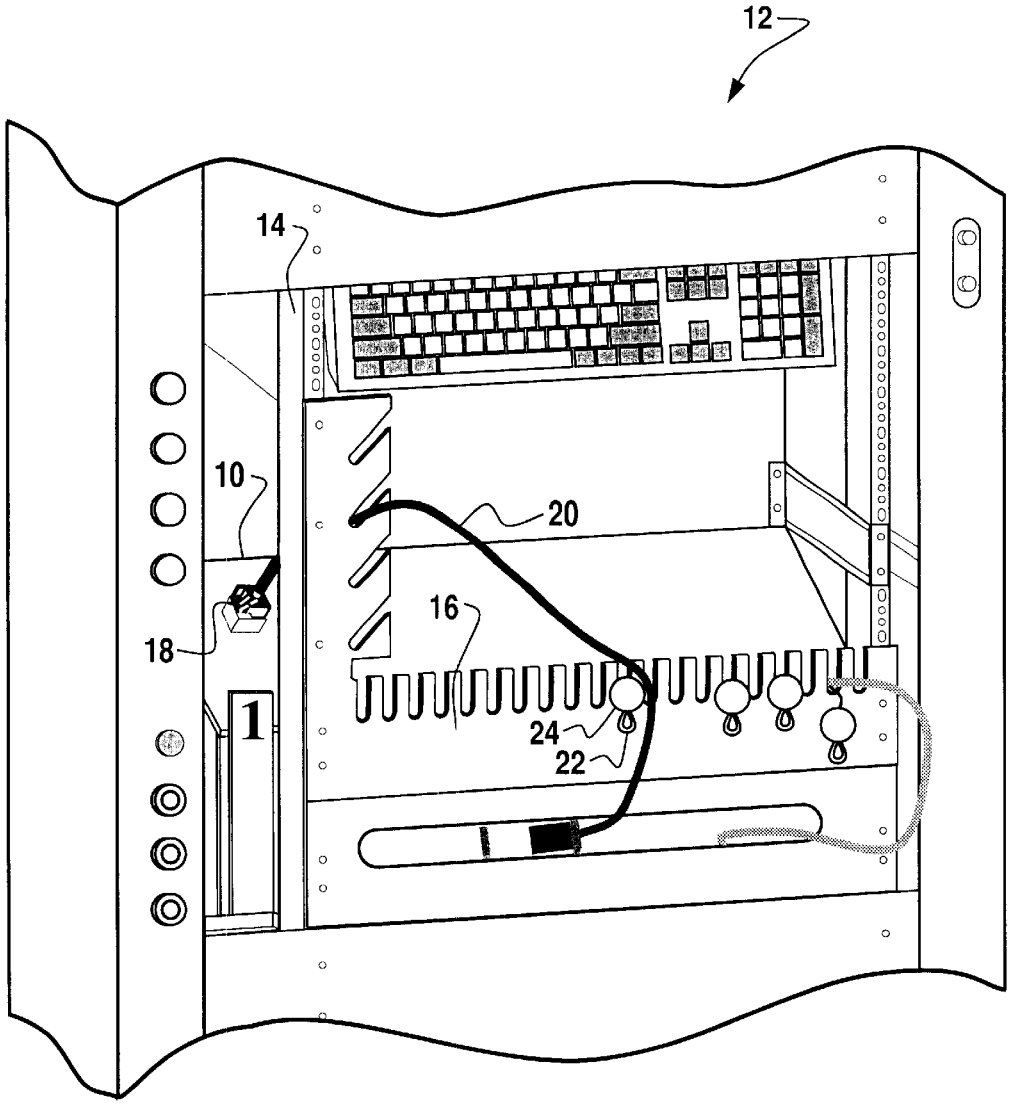
FIG. 1 is a perspective view illustrating an embodiment of a unit mounted on a burn rack.

A test unit 10, FIG. 1 is placed on a burn rack 12. A frame portion 14 of the burn rack includes a fixed member 16 attached thereto. A connector 18 is plug-in connected to the unit 10. The connector 18 has a cable 20 extending therefrom. A cord 22 and a catch member 24 are also connected to the connector as is explained more fully below.

Figure 2:
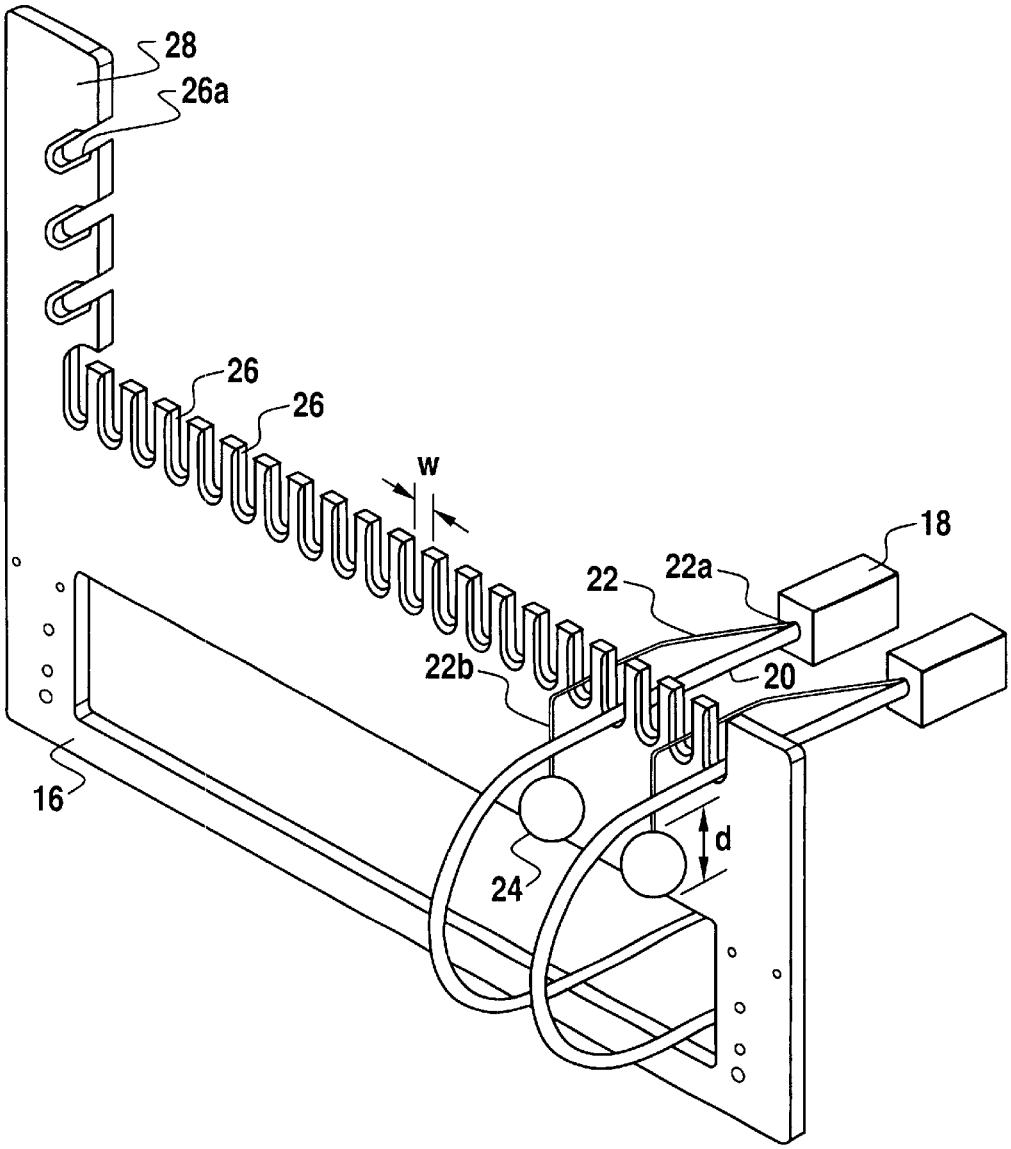
FIG. 2 is a perspective view illustrating an embodiment of a fixed member.
Figure 3:
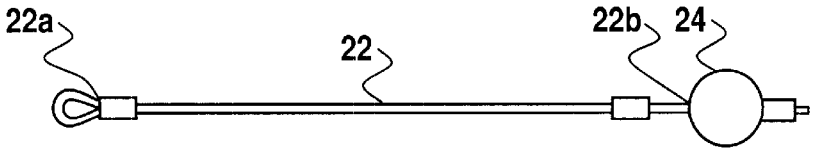
FIG. 3 is a view illustrating an embodiment of a cord and a catch member.

In FIG. 2, the fixed member 16 includes a plurality of groove openings 26 formed therein. The openings 26 are sized to permit cable 20 to pass therethrough. The cord 22, see FIGS. 2 and 3, has a first end 22*a* connected to or adjacent the connector 18. A second end 22*b* of the cord 22 includes the catch member 24 in the form of a ball having a diameter d which is larger than the width w of opening 26. As a result, the cord 22 and cable 20 are able to pass through opening 26 but the catch member 24 is unable to pass through opening 26.

Figure 6:
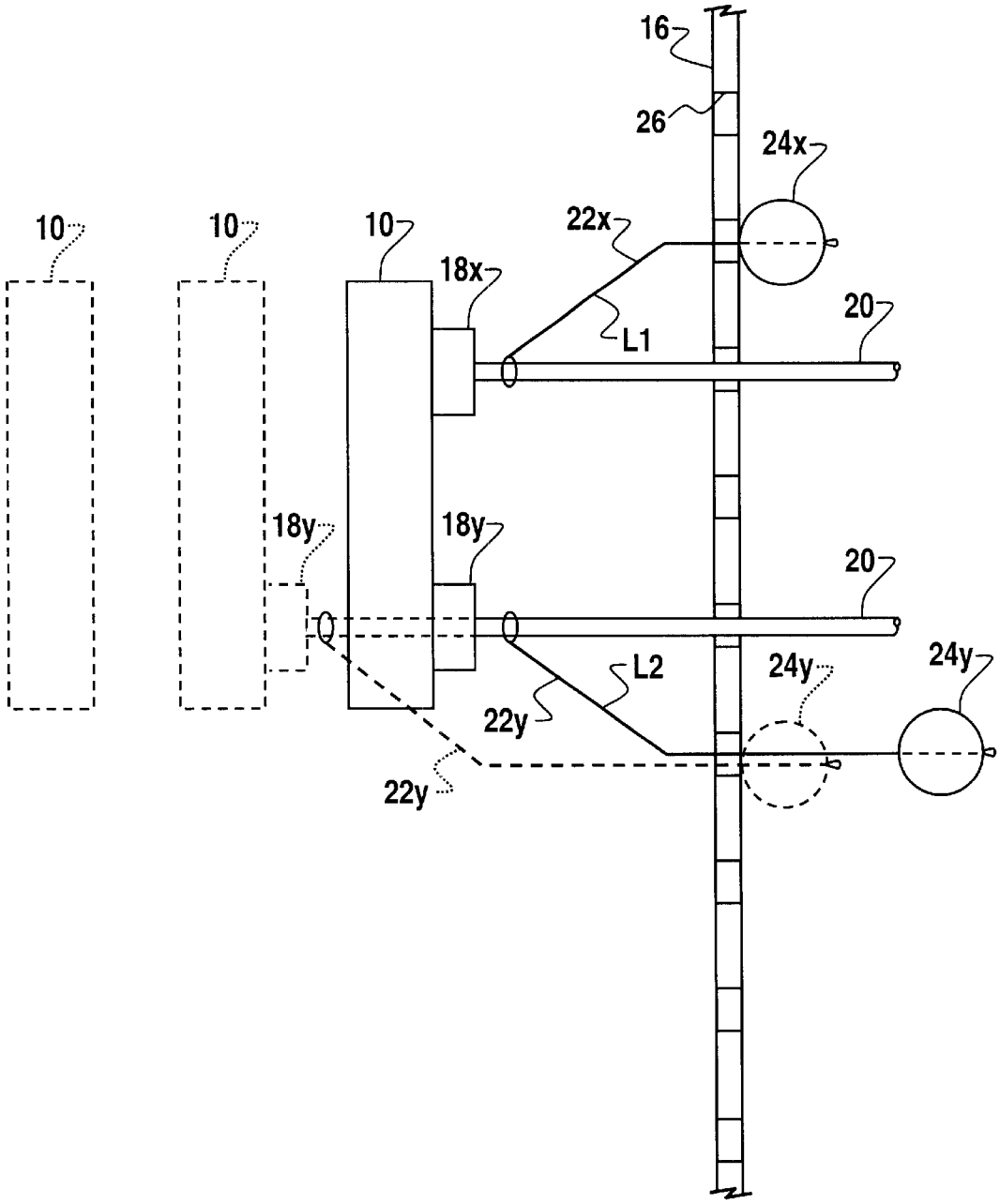
FIG. 6 is a diagrammatic view illustrating an embodiment of a sequential disconnect.

Because the required force to disconnect all of the connectors 18 simultaneously may be excessive, the lengths of the cords 22 may be varied, FIG. 6, so as to cause various connectors 26 to sequentially disconnect.

Figure 4:
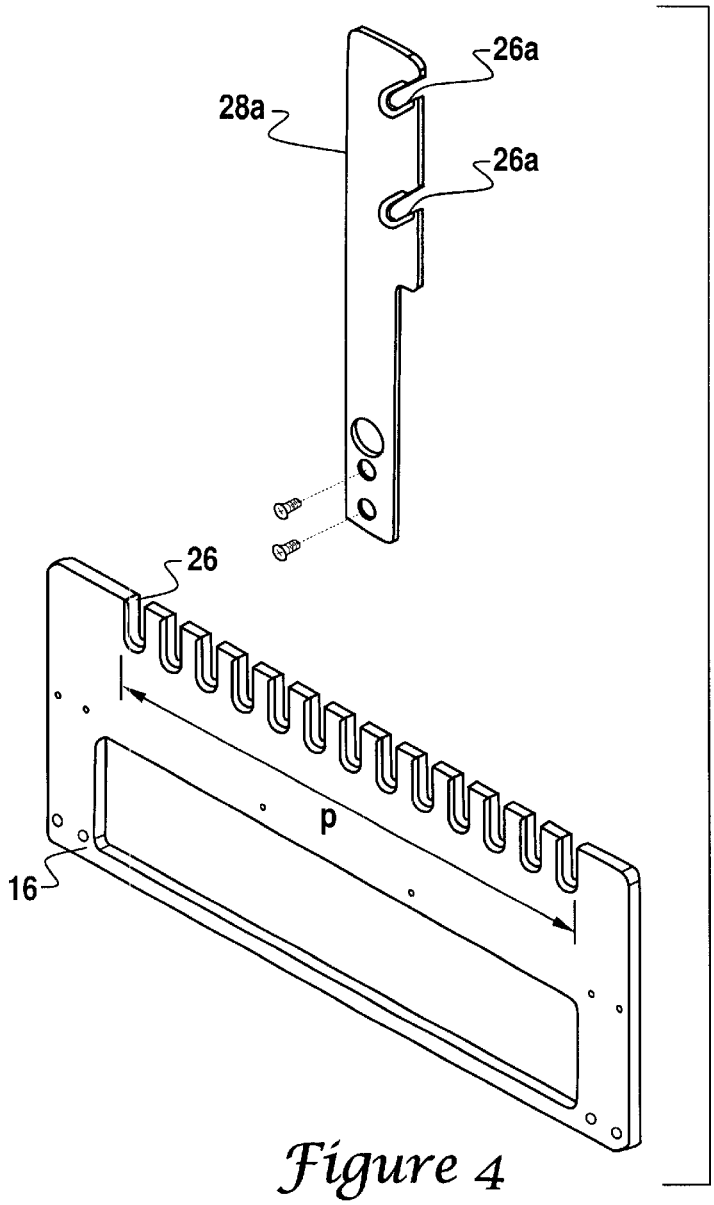
FIG. 4 is a perspective view illustrating another embodiment of a fixed member.

The fixed member 16 may include an extender 28, FIGS. 2 and 4. The extender 28 may be a formed part of the fixed member 16, FIG. 2, or may be a removable part 28*a*, FIG. 4. In this manner, the extender 28*a* may be moved to various positions (in direction P) on the fixed member 16. Extenders 28, 28*a* each include a plurality groove openings 26*a*, similar to openings 26 on the fixed member 16. The extenders 28, 28*a* permit the cables 20, cords 22 and catch members 24 to be arrayed conveniently with respect to the various plug-in positions on a test unit 10.

Figure 5:
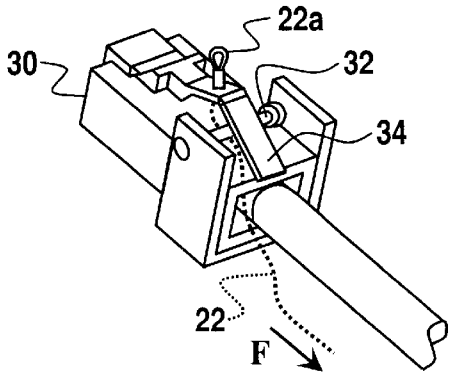
FIG. 5 is a perspective view illustrating an embodiment of a connector.

In the instances where a connector such as an RJ45 connector 30 is used, FIG. 5, the cord 22 may be arranged to release the connector 30. In one embodiment, the first end of 22*a* of cord 22 may be routed to pass under a pin 32 and attached to a resilient catch 34. When a force F is applied to tension cord 22, the catch 34 is flexed to release and connector 30 may be automatically disconnected without intervention by an operator. Other release mechanisms may also be devised which cause cord 22 to actuate a release device resulting from a tensile force applied to cord 22.

In operation, FIGS. 1–6, a plurality of connectors 18*x*, 18*y* are plugged into a unit 10. Each connector 18*x*, 18*y* includes a cord 22*x*, 22*y* and a catch member 24*x*, 24*y*. Each cord 22*x*, 22*y* is of a varying length so that as the unit 10 is moved away from the fixed member 16, each catch member 24*x*, 24*y* becomes restricted by the fixed member 16 in a sequence. For example, cord 22*x* has a length L1 and cord 22*y* has a length L2 which is greater than L1. Thus, as unit 10 is moved away from fixed member 16, catch member 24*x* engages fixed member 16 prior to catch member 24*y* engaging fixed member 16. As a result, the connector 18*x* is sequentially disconnected from unit 10 prior to connector 18*y*. Thus, the selective disengagement of the connectors 18 may be arranged to accommodate any desired sequence by varying the lengths of cords 22*x* and 22*y*.

Although illustrative embodiments have been shown and described, a wide range of modification, change and substitution is contemplated in the foregoing disclosure and in some instances, some features of the embodiment may be employed without a corresponding use of other features. Accordingly, it is appropriate that the appended claims be construed broadly and in a manner consistent with the scope of the embodiments disclosed herein.

What is claimed is:

1. An automatic disconnect apparatus for a plug-in device comprising:

a plug-in connector; having a resilient catch a cord having a first end attached to the resilient catch, and a second end extending from the connector;

a catch member attached to the second end; and a fixed member including an opening therein, the opening being of a size for permitting the cord to move therethrough and for restraining the catch member from moving therethrough;

whereby, movement of the connector away from the fixed member, moves the cord until the catch member engages the opening, so that the cord permits only limited movement of the connector.

2. The apparatus as defined in claim 1 wherein the fixed member is a plate and the opening is a groove formed in the plate.

3. The apparatus as defined in claim 1 further comprising:

a cable extending from the connector.

4. The apparatus as defined in claim 1 further comprising:

a frame supporting the fixed member.

5. The apparatus as defined in claim 2 wherein the catch member is a ball which is larger in diameter than the groove opening.

6. The apparatus as defined in claim 3 wherein the first end of the cord is attached directly to the connector.

7. The apparatus as defined in claim 3 wherein the first end of the cord is attached to the cable adjacent the connector.

8. An automatic disconnect apparatus for multiple plug-in devices comprising:

a plurality of plug-in connectors; each of said connector having a resilient catch a plurality of cords, each cord connected to a respective one of the connectors and including:

a first cord end attached to the resilient catch, and a second cord end extending from the connector; and a catch member attached to the second end;

a fixed member including a plurality of openings therein, each opening being of a size for permitting the cord to move therethrough and for restraining the catch member from moving therethrough;

whereby, movement of the connectors away from the fixed member, moves the cords until the catch members engage the openings, so that the cords permit only limited movement of the connector.

9. The apparatus as defined in claim 8 wherein the cords are of varying lengths.

10. The apparatus as defined in claim 8 further comprising:

an extender attached to the fixed member.

11. The apparatus as defined in claim 10 wherein the extender includes opening therein similar to the openings in the fixed member.

12. The apparatus as defined in claim 11 wherein the extender is fixedly attached to the fixed member.

13. The apparatus as defined in claim 11 wherein the extender is removably attached to the fixed member.

14. A method of automatically disconnecting a plurality of plug-in devices comprising:

providing an electronic unit having a plurality of plug receptacles;

providing a plurality of plug-in connectors in respective ones of the receptacles; each of said plug-in connector having a resilient catch positioning a fixed member near the units, the fixed member having a plurality of openings therein;

attaching a cord to each connector so that a first cord end is attached to the resilient catch, and a second cord end extends from the first cord end;

attaching a catch member to the second cord end, the catch member being of a size too great to pass through the opening;

passing each cord through a respective opening; and moving the unit away from the fixed member so that the cords move through the openings and the catch members engage the openings at varying times whereby the connectors disconnect from the unit in a staggered sequence.

15. The method as defined in claim 14 further comprising:

attaching an extender to the fixed member.

16. The method as defined in claim 14 further comprising:

fixedly attaching an extender to the fixed member.

17. The method as defined in claim 14 further comprising:

removably attaching an extender to the fixed member.

18. The method as defined in claim 15 further comprising:

providing openings in the extender similar to the openings in the fixed member.

* * * * *